United States Patent [19]

Balogh

[11] Patent Number: 4,684,852

[45] Date of Patent: Aug. 4, 1987

[54] FLASH LAMP CIRCUIT

[75] Inventor: Francis Balogh, Niagara Falls, Canada

[73] Assignee: Star Headlight & Lantern Company, Inc., Honeoye Falls, N.Y.

[21] Appl. No.: 707,350

[22] Filed: Mar. 1, 1985

Related U.S. Application Data

[63] Continuation of Ser. No. 422,520, Sep. 24, 1982, abandoned.

[51] Int. Cl.[4] ..... H05B 37/00; H05B 39/00; H05B 41/14

[52] U.S. Cl. ..... 315/241 R; 315/200 A; 315/241 S; 340/331

[58] Field of Search ..... 315/200 A, 205, 241 R, 315/241 S, 240, 241; 340/331

[56] References Cited

U.S. PATENT DOCUMENTS

| | | | |
|---|---|---|---|
| 3,543,087 | 11/1970 | Saiger et al. | 315/208 |
| 3,544,840 | 12/1970 | Saiger | 315/205 |
| 3,631,318 | 12/1971 | Hubbard | 315/209 R |
| 3,767,969 | 10/1973 | White et al. | 315/200 A |
| 3,771,017 | 11/1973 | Switsen | 315/200 R |
| 3,774,073 | 11/1973 | Switsen | 315/241 S X |
| 3,845,349 | 10/1974 | Liebman | 315/200 A |
| 4,007,399 | 2/1977 | White | 315/241 R |
| 4,041,351 | 8/1977 | Whitehouse et al. | 315/205 |

*Primary Examiner*—Saxfield Chatmon
*Attorney, Agent, or Firm*—Martin Lukacher

[57] ABSTRACT

A circuit for repetitively firing a flash or strobe lamp with voltage derived from the AC line without large and costly storage capacitors utilizes a voltage doubler having small capacitors one microfarad in capacitance value or less. A trigger circuit provides a high potential pulse to the trigger electrode of the lamp at or near the peak of the voltage from the AC line to provide flashes at a desired rate, say one per second. The circuit may be used in a warning light device.

20 Claims, 2 Drawing Figures

FLASH LAMP CIRCUIT

DESCRIPTION

This application is a continuation of Ser. No. 422,520 filed 9-24-82 now abandoned.

The present invention relates to circuits for firing flash or strobe lamps, and particularly to a circuit which is adapted to be connected to the AC lines for repetitively causing a flash lamp to fire at a predetermined rate. Circuits provided by the invention are especially suitable for use in warning lights to provide high intensity flashing.

Various circuits have been proposed for firing flash lamps. By flash lamps are meant strobe lamps and other high intensity gas discharge lamps. By firing such a lamp is meant ionizing the gas therein briefly so as to produce an intense flash of light. Most circuits for firing flash lamps from the AC lines have involved the use of storage capacitors for storing high voltage energy which is passed through the lamp on firing. Such capacitors are expensive and unreliable, especially under severe environmental conditions, such as over wide ranges of temperature to which warning lamps may be exposed. Attempts to avoid the use of large capacitors have involved complex circuits for timing the firing of the lamps (See U.S. Pat. No. 4,041,351 issued Aug. 9, 1977).

It is a principal feature of this invention to provide a simple, effective and reliable flash lamp circuit which may be implemented without large storage capacitors and complex timing circuits and which may be operated from the AC power line.

Briefly described, a circuit for firing a flash lamp in accordance with the invention may be operated from the AC power lines even though such power lines present peak voltage less than the ionization voltage of the lamp. The circuit includes means connected across the lines and across the lamp for storing energy for less than a period of the cycle of the AC voltage. Such means may be small capacitors, of capacitance value of one microfarad or less. Also connected to the AC line and to the lamp is a circuit for applying a trigger pulse to fire the lamp at or near the point during the cycle of the AC voltage when the peak voltage is reached. The firing circuit may include a silicon controlled rectifier (SCR) and small capacitors for storing sufficient energy from the AC line voltage to develop a pulse in a pulse transformer which is applied to the trigger electrode of the lamp to cause triggering thereof at or near the peak voltage presented by the AC line.

Figure 1:
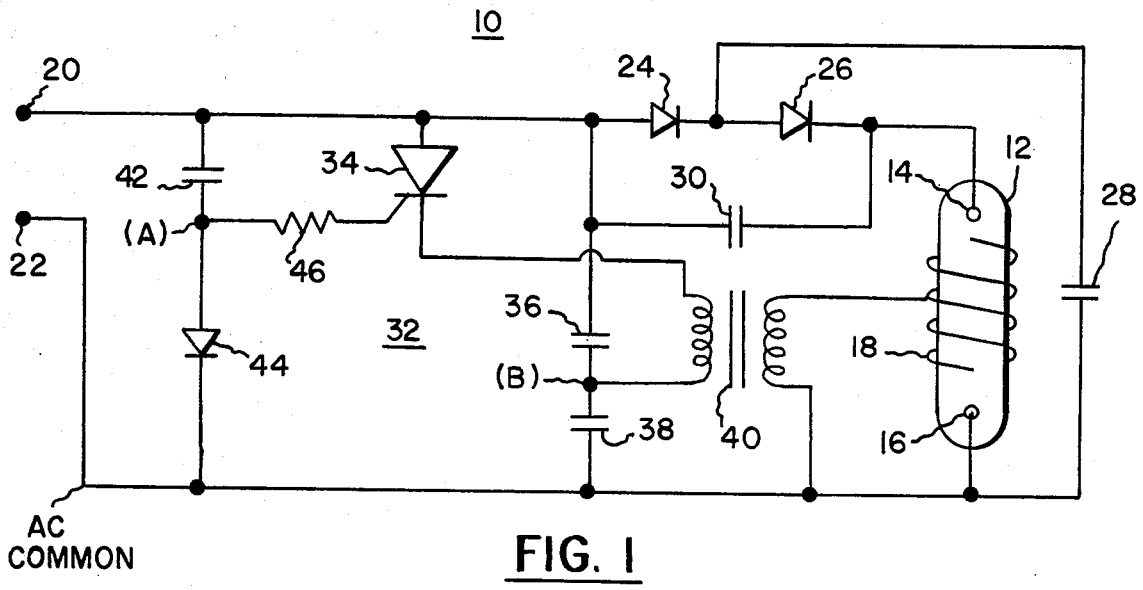
Figure 2:
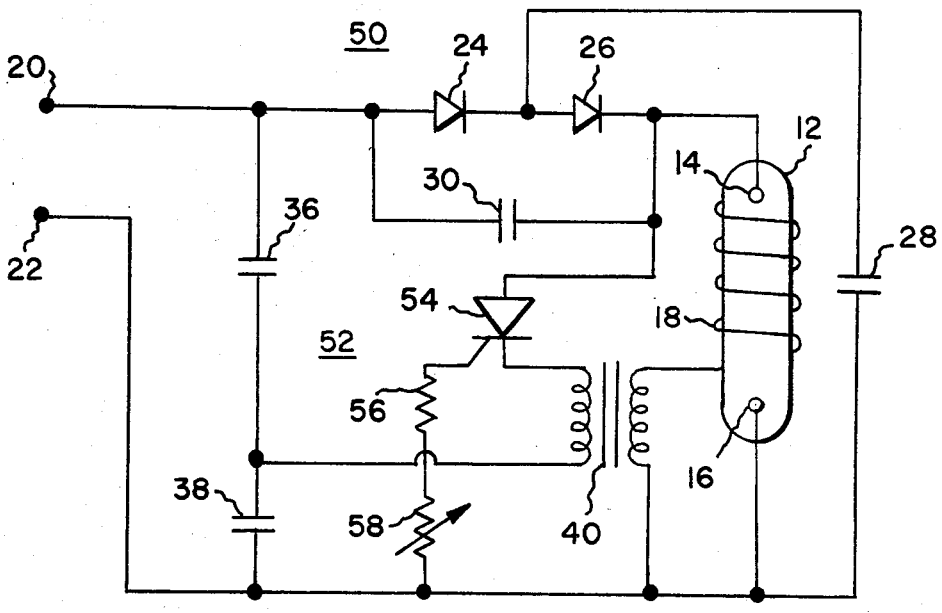

The foregoing and other objects, features and advantages of the invention and a presently preferred embodiment thereof will become more apparent from a reading of the following description in connection with the accompanying drawings in which:

FIG. 1 is a schematic diagram of a flash lamp circuit in accordance with a presently preferred embodiment of the invention; and FIG. 2 is a schematic diagram showing a flash lamp circuit in accordance with another embodiment of the invention.

Referring first to FIG. 1 the circuit 10 shown therein utilizes a conventional xenon gas flash or strobe lamp 12 having main electrodes 14 and 16 and a trigger electrode 18 in the form of a coil wound around the envelope of the lamp 12. The lamp is operated from the AC line; the opposite sides of which are connected to terminals 20 and 22 by a suitable plug or connector (not shown). The lamp has an ionization voltage which is higher than the peak voltage presented by the AC line. This ionization voltage may be from 200 to 300 volts. The AC line peak voltage with conventional 110 volts RMS voltage is approximately 160 volts. A voltage doubler circuit stores and presents a voltage across the main electrodes 14 and 16 of the lamp higher than the ionization voltage for a period of time period of time less than the period of a cycle of the AC voltage. This voltage doubler circuit includes a pair of diodes 24 and 26 which are connected in series with the lamp 12 across the AC line terminals 20 and 22. The diodes 24 and 26 are polarized in the same direction. They may be conventional diodes of the type used in industrial electronic devices. The voltage doubler circuit includes capacitors 28 and 30. The capacitor 28 is effectively connected across the gas tube by being connected between the junction of the diodes 24 and 26 and the side of the line connected to the terminal 22. The other capacitor 30 is connected in parallel with the diodes 24 and 26. During the positive cycle of the AC voltage, with 110 volts RMS AC, the lamp 12 will have a peak voltage of approximately 310 volts presented thereacross.

The capacitors 28 and 30 are small in value. Their capacitance value may be one microfarad or less. They are of equal capacitance value. Because of their small value, they essentially follow the AC voltage and store a voltage greater than the ionization voltage of the lamp 12 for a very short period of time in the region immediately adjacent to peak of the AC voltage It is necessary that a trigger pulse to fire the lamp 12 be applied to the trigger electrode 18 at or near the time that the AC voltage from the power line is at or near the peak value thereof. A trigger circuit 32, including a SCR 34, is switched into conduction at the proper time in the AC cycle to develop the trigger pulse which will cause the lamp 12 to flash. The lamp is flashed repeatedly when used as a warning lamp by means of trigger circuit 32. The repetition rate may suitably be one flash per second. The flash is very brief and only a few microseconds in duration. At the time the trigger pulse is applied to the trigger electrodes 18, the AC voltage is near its peak. Accordingly, some current is drawn through the diodes 24 and 26 from the AC line to brighten and intensify the illumination provided by the lamp during firing.

A pair of capacitors 36 and 38 establish the voltage between the anode and cathode of the SCR and also provide some energy storage to insure that trigger energy is available for the high energy trigger pulse when the SCR becomes conductive and fires. The anode to cathode path of the SCR extends through the primary winding of a pulse transformer 40 and through one of the divider capacitors 38 to the opposite side AC line at the terminal 22. The pulse transformer 40 may be a step up transformer of conventional design. The secondary is connected to the trigger electrode 18 and is returned to one side of the line; the side which is connected to the terminal 22. The timing and repetition rate of the pulses is obtained by means of a capacitor 42 and diode 44 which are connected in series across the AC line. A resistor 46 is connected between the junction of the timing determining capacitor 42 and the gate of the SCR 34. The resistor 46 may be of approximately two to four megohms in value of resistance as to provide for a flashing rate of approximately one flash per second. The value of the resistor 46 and also the value of the one of the capacitors 38 which is in the gate to cathode portion of the SCR 34 may also be varied in order to select the flash repetition rate as well as to insure that the trigger pulse is produced and applied to the trigger electrode 18 at or near the peak of the AC voltage presented by the AC line.

Without limiting the invention to any mode of operation the following theory of operation is presented to further elucidate the invention.

Diode 44 and capacitor 42 form a negative 310 V peak supply with the clamping action provided by diode 44: Point (A), with resistor 46 being in the megohm region, essentially follows the voltage of the AC line, but is clamped to −AC or common by diode 44. The gate of the SCR 34 thud "sees" the voltage at point (A) through resistor 46.

The voltage doubling network of diodes 24 and 26 and capacitors 28 and 30 provide a high voltage source for the initial arc conduction of the lamp 12. Capacitor 28 charges to the peak line voltage and capacitor 30 charges to twice the peak line voltage.

Since capacitors 36 and 38 are of the same value, the AC voltage existing at point (B) is essentially ½ the peak to peak AC line voltage or approximately 160V peak to peak.

When SCR 34 fires near the peak positive AC line voltage, capacitor 38 will charge to the peak line voltage and capacitor 36 will discharge through the SCR 34. The current flowing through capacitors 36 and 38 and the SCR produces a pulse in transformer 40 which triggers the lamp 12 on at the peak AC line voltage point. The lamp 12 draws current out of capacitors 28 and 30 and directly from the AC line for approximately 4.1 milliseconds. The lamp 12, diodes 24 and 26 and the wire resistance of the circuit limit the current drawn from the AC line while the lamp 12 conducts.

After the lamp fires, Point (B) has a net DC potential. This potential is what provides the source for the delay time before the SCR 34 fires again. Timing between flashes occurs in the following manner. After the lamp 12 fires, the cathode of the SCR 34, referred to the gate thereof, is back biased by 200–300 volts. The gate to cathode junction breaks over in the reverse direction and current flows from the capacitors 36 and 38 through the large timing resistor 46 to point (A). Thus the point (B) average voltage decreases and tends to discharge towards the point (A). Since the point (A) is at a higher peak to peak voltage than point (B), eventually the gate to cathode junction of the SCR will become forward biased (near a positive peak line voltage point) and the SCR will fire, again triggering the lamp 12. The cycle then repeats itself.

Referring to FIG. 2 there is shown another circuit 50 which implements the invention. The parts and components of the circuit 50 which are similar to those of the circuit 10 shown in FIG. 1 are identified by like reference numerals. The difference between the circuits 10 and 50 is in the circuit 52 for generating and applying the trigger pulse to the trigger electrode 18. The trigger electrode 18 is shown also connected to the secondary of the pulse transformer 40 at the lower end of the winding which constitutes the electrode 18.

In the trigger circuit 52, an SCR 54 is used. The anode of the SCR 54 is connected to the output end of the diodes where half wave rectified AC voltage appears. The cathode is connected through the primary of the pulse transformer and one of the voltage dividing, trigger energy supplying capacitors 38. Capacitor 38 also provides part of the timing circuit for timing the firing and rendering conductor of the SCR 54. This firing circuit includes a fixed resistor 56 and a variable resistor 58 which are connected between the gate electrodes of the SCR 54 so as to be in parallel with the primary winding of the transformer 40 and the capacitor 30 via the gate and cathode portion of the SCR 54. The resistor 56 may have a value of approximately 10 megohms. The variable resistor 58 may insert up to two megohms in a series with the resistor 56. By adjusting this resistance with respect to the capacitance of the capacitor 38, both the repetition rate of the trigger pulse and the timing thereof to be at or near the peak of the AC voltage is obtained. In the circuit 10, the divider capacitors 36 and 38 and the timing capacitor 42 are suitably one microfarad in capacitance or less. In circuit 50 (FIG. 2) the capacitor 36 may be of zero point one microfarad value. The capacitor 38 may vary in value from 0.1 to 0.47 microfarads depending on the value of the resistors 56 and 58. In both circuits the SCR 34 or 54 may be type C 103 manufactured by the General Electric Company.

From the foregoing description it will be apparent that there has been disclosed improved flash lamp circuits especially for use in warning lamps. Variations and modifications in the herein described circuits, within the scope of the invention, will in all likelihood become apparent to those skilled in the art. For example, a diode connected between the cathode and gate of the SCR to avoid junction breakdown. Also, to vary light intensity, the input AC voltage may be reduced or a phase shifting network may be connected at the AC input. Accordingly, the foregoing description should be taken as illustrative and not in a limiting sense.

I claim:

1. A circuit for firing a flash lamp from AC power lines having a peak voltage less than the ionization voltage for initial arc conduction of said lamp when said lamp is fired which comprises means connected across the AC lines and across said lamp for storing energy for less than the period of a cycle of the AC voltage from said lines at a voltage higher than said ionization voltage for initial arc conduction and means included in said means connected across said lines for providing a direct path for current flow through said lamp from said lines continuously during said initial arc conduction and for sustaining arc conduction, said storing means consisting of the only energy storing means in the circuit for developing said ionization voltage for arc conduction of said lamp which are connected to said lamp, and means included in said storing means directly connecting said lamp across said lines to enable current flow from said lines through said lamp during ionization when said lamp fires, and means also connected to the AC lines and to said lamp for applying a trigger pulse to fire said lamp at or near the point during the said cycle when said peak voltage is reached and to enable current flow to said lamp from the AC lines.

2. The circuit according to claim 1 wherein said trigger pulse applying means include means for generating said trigger pulse repetitively to repetitively flash said lamp.

3. The circuit according to claim 1 wherein said energy storing means includes capacitors for storing said energy all of which are of value not exceeding one microfarads.

4. The circuit according to claim 3 wherein said storing means has a pair of diodes connected to said capacitors and in voltage multiplying relationship therewith.

5. The circuit according to claim 4 wherein said diodes are connected polarized in the same direction and in series with said lamp across said AC lines, one of said capacitors being connected between the junction of said diodes and the junction of said lamp and one side of said AC line, and the other of said capacitors being connected across both said diodes.

6. The circuit according to claim 5 wherein said capacitors are approximately equal in capacitance value.

7. The circuit according to claim 6 wherein the capacitance value of said capacitors is 0.1 microfarad or less.

8. The circuit according to claim 5 wherein said trigger pulse applying means comprises an SCR having an anode, a cathode and a gate, a pulse transformer having a primary and secondary windings, a pair of capacitors connected in series with each other across said AC line, a connection between one of said anode and cathode of said SCR and one side of said AC line, the other of said anode and cathode being connected to the junction of said pair of capacitors via the primary of said pulse transformer, means for determining the timing of said trigger pulse connecting said gate to at least one of a sides of said AC line, and means connecting said secondary to said flashlamp for applying said trigger pulse thereto.

9. The circuit according to claim 8 wherein said trigger pulse and timing determining means comprises a capacitor and diode connected in series across said AC lines and a resistor connected between said gate and the junction of said last named capacitor and diode.

10. The circuit according to claim 8 wherein said trigger pulse timing determining means comprises at least one resistor connected between said one of the sides of the said AC line and said gate and in parallel with said primary and one of said pair of capacitors via the gate and cathode of said SCR.

11. A flash lamp circuit operable from the AC power lines comprising a gas discharge flash lamp having main electrodes and a trigger electrode, a pair of diodes connected in series and polarized in the same direction between one side of the AC lines and one of said main electrodes, the other of said main electodes being connected to the other side of said AC lines, first and second capacitors of capacitance value of one microfarad or less and consisting the only means in said circuit for developing a voltage greater than the ionization voltage of said lamp for initial arc conduction when said lamp fires, said first capacitor being connected across said series connected diodes and directly connecting said one side of said AC lines to said one of said main electrodes thereby connecting said lamp directly across said AC lines to enable current flow to said lamp from said lines when said lamp fires, said second capacitor being connected between the junction of said diodes and the other of said main electrodes, and means connected to said trigger electrode and said AC lines for applying a trigger pulse at or near the peak voltage of the AC voltage to fire said lamp and enable current flow to said lamp from the AC lines.

12. The circuit according to claim 11 wherein said first and second capacitors are equal in capacitance value.

13. The circuit according to claim 12 wherein the capacitance value of said first and second capacitors is 0.01 microfarads.

14. The circuit according to claim 11 wherein said trigger pulse applying means comprises a pulse transformer having a primary and a secondary, a SCR having an anode, cathode and gate, third and fourth capacitors connected in series across the AC lines, a connection between one of said anode and cathode of said SCR and one side of said AC lines, the other of said anode and cathode being connected to the junction of said third and fourth capacitors via the primary of said pulse transformer, means for determining the timing of said trigger pulse connecting said gate to at least one of said sides of said AC lines and means connecting said secondary to said flashlamp trigger electrode.

15. The circuit according to claim 14 wherein said trigger pulse timing determining means comprises a fifth capacitor and third diode connected in series across said AC line, and a resistor connected between said gate and the junction of said fifth capacitor and third diode.

16. The circuit according to claim 14 wherein said trigger pulse timing determining means comprises at least one resistor connected between said one of the sides of said AC line and said gate and in parallel with said primary and said fourth capacitor via the gate and cathode of said SCR.

17. A circuit for firing a gas flash lamp from AC power lines, which lines provide the gas ionization sustaining current through said lamp, and without any storage capacitor for supplying the ionization sustaining current, said circuit comprising: first means, including at least one diode directly connecting said lines and said lamp, and connecting said lamp directly across said lines; for providing a direct path for current flow through said lamp from said lines continuously during said initial arc conduction and for sustaining arc conduction second means, including said diode, for developing a voltage of sufficient magnitude for initial arc conduction through said lamp at or near the peak of the AC voltage from said power lines and insufficient to maintain the ionization sustaining current through said lamp; and third means, connected to said lines and said lamp for applying a trigger pulse to fire said lamp at or near the peak of said AC voltage to enable the ionization sustaining current flow through said lamp from said lines.

18. The circuit according to claim 17 wherein said second means comprises at least one capacitor connected across said diode.

19. The circuit according to claim 18 wherein said one capacitor and any other capacitor in said circuit are of a value of one microfarad or less.

20. The circuit according to claim 18 wherein said second means includes means defining a voltage multiplying circuit for providing a DC voltage as said voltage of sufficient magnitude for initial arc conduction through said lamp.

* * * * *